United States Patent [19]

Milberger et al.

[11] Patent Number: 4,580,630

[45] Date of Patent: Apr. 8, 1986

[54] MUDLINE CASING HANGER ASSEMBLY

[75] Inventors: Lionel J. Milberger; Jimmy R. Martin, Jr.; Thomas P. Mataway; Charles E. Gibbs, all of Houston, Tex.

[73] Assignee: Vetco Offshore, Inc., Ventura, Calif.

[21] Appl. No.: 642,003

[22] Filed: Aug. 20, 1984

[51] Int. Cl.[4] ..... E21B 23/00

[52] U.S. Cl. ..... 166/208; 166/217

[58] Field of Search ..... 166/208, 206, 115, 217, 166/348, 382; 285/140, 142, 143, 4

[56] References Cited

U.S. PATENT DOCUMENTS

| | | | |
|---|---|---|---|
| 3,497,243 | 2/1970 | Gruller et al. | 285/322 X |
| 3,827,488 | 8/1974 | Piazza et al. | 166/208 X |
| 3,924,678 | 12/1975 | Ahlstone | 166/208 X |
| 4,139,059 | 2/1979 | Carmichael | 166/208 |
| 4,355,825 | 10/1982 | Leicht | 166/217 X |

*Primary Examiner*—Stephen J. Novosad
*Assistant Examiner*—Thuy M. Bui
*Attorney, Agent, or Firm*—Edward L. Kochey, Jr.

[57] ABSTRACT

A mudline casing hanger assembly wherein a collet 32 latches 20 to a hanger body 10 and positions rotatably attached fingers 40. These fingers rotate outwardly to fit between load surface 24 and load surface 30 whereby hanger body 12 is carried on hanger body 10 thru compression loading of the fingers 40.

14 Claims, 5 Drawing Figures

MUDLINE CASING HANGER ASSEMBLY

BACKGROUND OF THE INVENTION

This invention relates to oil and gas well casing hanger apparatus, and in particular to a mudline casing hanger assembly for supporting the casing at the mudline of a subsea well.

In such an apparatus commonly known as a mudline suspension system, a plurality of strings of casing are concentrically located, each one being supported within the successively outer one at the mudline. Each casing string which runs from the hanger downwardly is matched by an upward extension or conductor passing to the surface platform. Such a system is characterized by the severe limitation on annular space through which to run a hanger for support from the next adjacent hanger body.

The use of this annular space is further restricted by the need to obtain mud flow by area, both while running the hanger, and after the hanger has been landed. It is desirable that the hanger be capable of carrying high loads, and accordingly stress concentrations should be avoided. It is also desirable that the hanger be simply and reliably run.

One mudline hanger is illustrated in U.S. Pat. No. 4,139,059 issued to James T. Carmichael. This illustrates a split collet which is carried down with an inner hanger body by a ring. The collet latches to the outer hanger body at a preselected location, and the ring shears disengaging the collet from the inner body. Further downward movement of the inner body results on the body sitting on, and being supported by the collet.

In such a system the collet carries the entire load, and accordingly must be substantially sized. This provides limitations on available flow by. Since the support is through the collet on to the latching means the collet must be closely toleranced to assure approximately equal distribution of the load around the circumference. Furthermore, such a collet is continuously outwardly urged during the running operation and therefore the load bearing member, which is the collet, is dragged through the entire length of conductor from the surface to the support elevation.

An alternate mudline suspension system is shown in U.S. Pat. No. 3,497,243 issued to D. L. Gruller et al. This arrangement includes a plurality of downwardly extending fingers which are threadedly supported in a raised position within the outer hanger body. When the inner casing hanger body is to be supported, a tool is run down the string, rotating the apparatus to lower the downwardly extending fingers. These fingers are cammed in by the outer hanger body to provide a conical support surface for the later run inner hanger body.

The system requires two trips, one for moving the fingers, and the second for actually landing the casing hanger. The fingers are in place throughout the drilling operation which leads to possibility of wear, and damage to these load bearing surfaces. Furthermore, rotation of the drill string could cause premature energization of the mechanism driving the fingers down prematurely. These fingers also depend on a upwardly facing abutment to stop their movement. With the hanger body being in place during the drilling operation the potential exists for this abutment to become plugged or jammed such that the fingers override, and not engage the abutment. Modifications which could be made to assure engagement of the fingers with the abutment could result in even sharper corners at this high stress area, thereby leading to high stress concentrations.

Still another arrangement is illustrated in U.S. Pat. No. 4,355,825 issued to Leicht. This illustrates a C-shaped collet which rotates with the upper end moving outwardly to engage the collet latching means. Again, however, the entire load is carried through the collet resulting in size limitations for the highly loaded collet, and high stress concentrations at the sharp corners in the area of this support.

SUMMARY OF THE INVENTION

A mudline casing hanger assembly with an outer hanger body having a latching means for engaging and locating a collet, and a steeply tapered load surface a predetermined distance from the latching means. An inner hanger body carries a collet down, and includes a steeply tapered outwardly extending load surface substantially parallel to the load surface of the outer hanger body. A collet is releasably secured to the inner hanger body with the collet having as its purpose pulling down support fingers, and locating the support fingers the proper distance from the latching means. A plurality of upwardly extending fingers are rotatably attached to the collet so that after being located by the collet they may rotate outwardly between the two steeply tapered load surfaces, whereby the entire load is carried on the fingers and not on the collet.

With this invention, only a lightweight low duty collet is required since its primary function is to locate the support fingers with respect to the collet latching means. The latching means need only be reliable and sufficiently secure to disengage the collet from the inner hanger body. Since the collet is not the load carrying member it does not require the expensive high toleranc-ing required by the conventional load carrying collets.

This casing hanger is run on a one trip system and requires no rotation to energize the hanger. Furthermore, the support fingers which will carry the load are not in place during drilling, and accordingly cannot be damaged during the drilling.

The structure of the invention also avoids sharp corners in the high load area, thereby avoiding local high stresses. There furthermore is no radial force on the fingers during the running operation thereby avoiding wear of the load carrying surface at that time.

This casing hanger assembly also provides flexibility in design selection between flow by while running, and landed by selecting the thickness of the fingers.

DESCRIPTION OF THE PREFERRED EMBODIMENT

Figure 1:
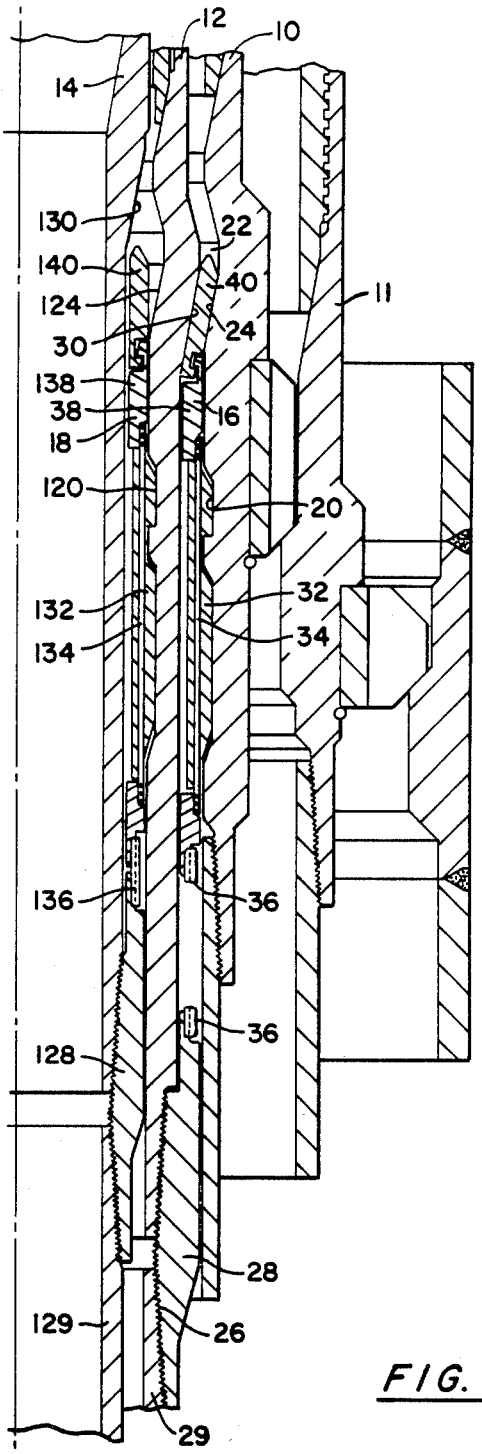
FIG. 1 is a sectional side elevation of the casing hanger assembly illustrating interlocked fingers.

An outer casing hanger body 10 is supported from a subsea wellhead 11 in a conventional manner. An intermediate casing hanger body 12, and an inner casing hanger body 14, are to be concentrically supported within the outer casing hanger body 10, the intermediate hanger body 12 is the internal hanger body with respect to finger support system 16 and the outer hanger 10. This hanger body 12 is however the outer hanger body with respect to the inner hanger body 14, and the finger support system 18. The finger support system 16 is illustrated in the load carrying position while the finger support system 18 is illustrated in the latched position before the inner body 14 is lowered to the support position.

The outer hanger body 10 has at its inner surface a latching means or groove 20 for latching a collet at a predetermined location. A recess 22 is located a predetermined distance from the groove, and is bounded on its bottom by a steeply tapered first load surface 24, which is preferably at an angle between 6° and 20° from the vertical. The intermediate hanger body 12 carries a lower collet ring 28 having threads 26 for supporting casing 29 from the hanger body. This hanger body includes a steeply tapered outwardly extending second load surface 30 which is substantially parallel to the first load surface 24.

An outwardly urged collet 32 is secured around the hanger body 12 within a cage 34. The collet is arranged to move radially within the cage, but may not move vertically with respect to the cage. Accordingly, setting the elevation of the collet sets the elevation of the cage 34. The collet through the cage 34 and tensile coupon 36 was releasably secured to the intermediate hanger body 12, but is illustrated here in the released position, wherein the tensile coupon has been fractured. The cage 34 carries at its upper end a finger securing ring 38 which is also located a predetermined distance from the latching means 20 when the collet 32 is in its latched position. The finger securing ring 38 carries a plurality of rotatably attached fingers 40 at the upper end, which in this embodiment are interlocked with the ring.

Figure 2:
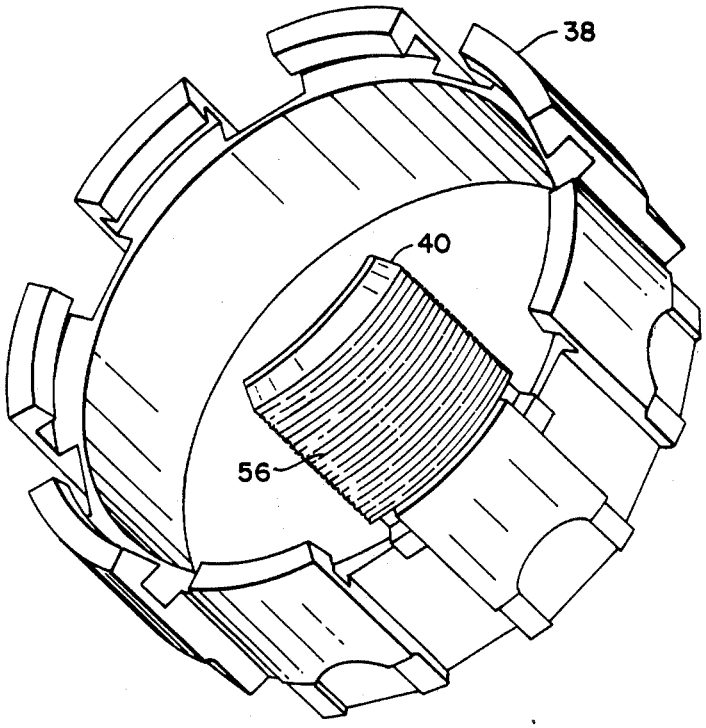
FIG. 2 is an isometric view of a finger cage for engaging the interlocked fingers.

FIG. 2 is an isometric view of the ring 38 showing the location of one of the fingers 40. The interlocking arrangement shows one method of rotatably attaching the fingers.

The intermediate casing hanger body 12 in its function as the outer casing hanger body with respect to finger assembly 18, includes groove 120 as a means for locating or latching the collet. It includes a load surface 124 a predetermined distance from the groove 120.

Similarly, the inner casing hanger body 14 includes a lower collet ring 128 carrying casing 129. Tensile coupon 136 secures the cage 134 to the hanger body 14. Collet 132 is affixed inside the cage so that it may move radially with respect to the cage 134, but may not move vertically with respect thereto. The cage carries at its upper end a finger securing ring 138 which rotatably supports a plurality of fingers 140. The hanger body 14 includes a load surface 130 which is substantially parallel to load surface 124 of hanger body 12.

Figure 3:
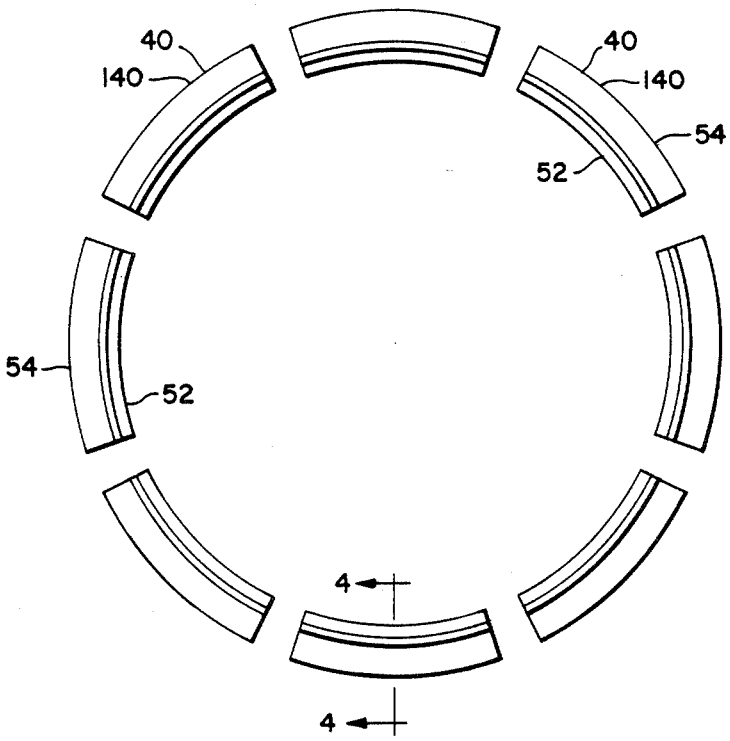
FIG. 3 is a plan view through the fingers while the hanger is running.
Figure 4:
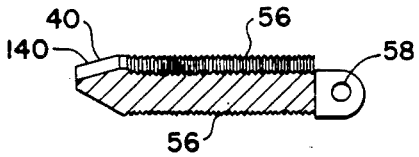
FIG. 4 is a detail of a finger, also showing an alternate attachment means.

FIGS. 3 and 4 show details of the fingers 40 and 140 with the fingers preferably being arcuate in shape having an inner surface 52 conforming to the downwardly facing load surfaces 30 and 130, respectively, and an outer or lower surface 54 which conforms to the upwardly facing load surfaces 24 and 124, respectively. Serrations 56 are located on the upper and lower surfaces of each finger, which surfaces may be hardened by nitriding.

FIG. 4 also illustrates an alternate means of rotatably connecting the fingers to the collet wherein they are pivotally connected by pin 58.

Figure 5:
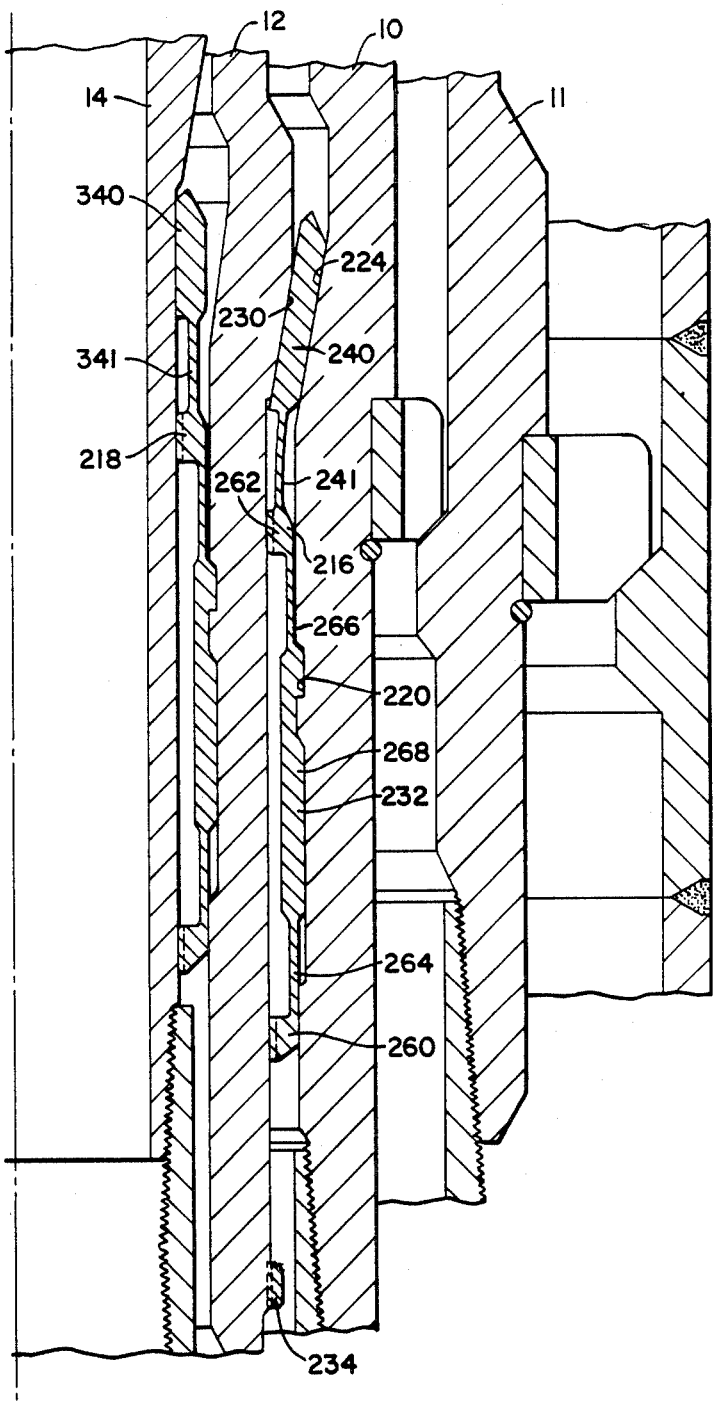
FIG. 5 is a side elevation showing a flexible attachment of the fingers and an alternate collet.

FIG. 5 shows an alternate embodiment wherein the fingers 240 are rotatably attached to the collet 232 by flexible straps 241. An alternate collet is also shown.

Collet 232 is releasably secured to the intermediate hanger body 12 by a frangible attachment to ring 234, although this attachment has been broken in a position illustrated in this figure. Feet 260 and 262 fit loosely around the hanger body. Flexible straps 264 and 266 carry the latching portion 268 of the collet 232 in a manner to urge it outwardly. At the proper elevation the latching portion 268 will latch into groove 220 thereby locating the finger support system 216. The fingers 240 are rotatably attached to the collet by flexible straps 241 which permit them to rotate outwardly. Accordingly, when the collet is latched and the casing hanger body 12 is lowered, fingers 240 are urged outwardly being engaged on the lower surface by a load surface 224 and on the upper surface by a load surface 230.

Also illustrated in FIG. 5, is finger support system 218 which is shown in the position where the collet has latched to the casing hanger body 12, but the collet has not yet been broken loose from the casing hanger body 14. In this case the fingers 340 being supported by flexible strap 341 are still in the fully up position.

Prior to running the hanger system, the collet is placed around the hanger body with the fingers attached while still at the surface. As the casing hanger passes through the conductor string, the collet is squeezed inwardly by the pipe, and moves downwardly with the casing hanger body carrying the fingers therewith. Only when the support elevation is reached with a properly sized and shaped groove 20 or 220 does the collet spring out and engage the means for latching the collet. Further downward movement of the casing hanger body breaks loose the collet from the hanger body, the method shown here being the fracture of tensile coupon 136 in FIG. 1 and ring 234 in FIG. 5. This just at the moment of fracture produces the position shown by finger support system 18 and 218 in FIGS. 1 and 5, respectively. It can be seen that the fingers 140 and 340 are adjacent a recess in the previously run casing hanger body, although there is no force at this time causing the fingers to move within the recess. After release of the collet from the casing hanger body, the casing hanger body moves downwardly toward the position illustrated by hanger body 12 with respect to the finger assembly 16 in FIG. 1, and the finger assembly 216 in FIG. 5. The downwardly facing load surface 30 and 230 urges the fingers outwardly until they reach the final position of load carrying engagement between the load carrying surfaces 24 and 30 of FIG. 1, and the load surfaces 224 and 230 of FIG. 5.

It is noted that the collet functions to carry the fingers 240 down to the support elevation where the collet latches to the previously run hanger body. At this time the function of the collet is to locate the support fingers at the predetermined distance from the latching elevation. This location of the fingers is the location at which the load is to be carried. The collet need only reliably latch at the proper elevation, and the only strength required at this time is that which is sufficient to break the collet loose from the casing hanger body by any attachment means which may have been used. Accordingly, the collet need only be of lightweight design and need not be massive. Accordingly, ample flow by for passage of mud through the annular space can easily be obtained both in the latched and running condition.

Similarly, any finger supporting ring such as 138 used to carry the fingers is also light duty, and ample flow by may easily be obtained.

Flow by past the fingers during the landed condition is limited to the space between the fingers. The space is a function of both the spacing between the fingers and the thickness of the fingers. While running the flow by is a function of the spacing between the fingers as well as the difference between the thickness of the fingers, and the annular space available between the hanger body and the conductor. Accordingly, appropriate modification of available flow by in each of the two conditions may be made by selection of the thickness of the fingers as well as the spacing thereof.

In selecting the thickness of the fingers the load transfer condition must also be considered. The outer hanger body has a minimum inside diameter, generally consistent with the inside diameter of the conductor so that the drill may be passed through the conductor and the hanger body. The inner hanger body is limited to this as a maximum diameter, since it must pass through the conductor. Accordingly, it can be seen that the load carrying surface 30 of the inner hanger body can not be vertically above the load carrying surface 24 of the outer hanger body. The load must be transferred between these two surfaces by the finger 40. The amount of surface effectively transferring load increases as the thickness of the finger is increased. Accordingly, the thickness of the fingers must be sufficient to provide acceptable bearing loads.

It is noted that there is no outward force on the fingers during the running operation as there is with the collet. The fingers are moved outwardly only by the load carrying surface after the collet has broken loose from the hanger body. Accordingly, no wear occurs on the load carrying surface during the running operation. Furthermore, since the support fingers are not in place during the drilling operation there is no possibility of damaging their surfaces during drilling.

It is also noted that the hanger bodies in the area of the load bearing surfaces require no sharp corners, but only slight bends. Accordingly, stress concentrations which are notoriously high at sharp corners are avoided in the casing hanger bodies.

The concept of using the collet predominantly for locating the load supporting fingers reduces the structural requirements of the locating collet by an order of magnitude, which opens the design to a considerable number of collet or finger locating concepts.

We claim:

1. A mudline casing hanger assembly comprising:
an outer hanger body;
an inner hanger body;
means for supporting casing from said inner hanger body;
a collet having latching means and releasably secured to said inner hanger body;
a plurality of upwardly extending fingers rotatably attached to said collet;
said outer hanger body having at its inner surface latching means for latching said collet at a predetermined location, and a recess for receiving said fingers at a predetermined distance from said latching means, said recess bounded on the bottom by a steeply tapered first load surface;
said inner hanger body having a steeply tapered outwardly extending second load surface substantially parallel to said first load surface; and
said fingers located on said collet a distance from the latching means such that, when said collet is latched said fingers rotate outwardly at a location to move within said recess and rest on said first load surface, said second load surface resting on said fingers after the release of said collet from said inner hanger body.

2. A mudline casing hanger assembly as in claim 1: said upwardly extending fingers being interlocked to said collet.

3. A mudline casing hanger assembly as in claim 2: said steeply tapered load surfaces having an angle with respect to the vertical between 6° and 20°.

4. A mudline casing hanger assembly as in claim 2: the upper and lower surfaces of said fingers being serrated.

5. A mudline casing hanger assembly as in claim 1: said upwardly extending fingers being pivotally attached to said collet.

6. A mudline casing hanger assembly as in claim 5: said steeply tapered load surfaces having an angle with respect to the vertical between 6° and 20°.

7. A mudline casing hanger assembly as in claim 5: the upper and lower surfaces of said fingers being serrated.

8. A mudline casing hanger assembly as in claim 1: said steeply tapered load surfaces having an angle with respect to the vertical between 6° and 20°.

9. A mudline casing hanger assembly as in claim 1: the upper and lower surfaces of said fingers being serrated.

10. A mudline casing hanger assembly as in claim 1: said upwardly extending fingers being attached to said collet by flexible straps.

11. A mudline casing hanger assembly comprising:
an outer hanger body;
an inner hanger body;
means for supporting casing from said inner hanger body;
a collet having latching means and releasably secured to said inner hanger body;
said collet having a plurality of lower feet and a plurality of upper feet, each plurality of feet loosely surrounding said inner hanger body;
latching means on said collet comprising an outwardly extending member located vertically between said upper and lower plurality of feet;
flexible straps connecting said latching means to said upper and lower feet and urging said latching means outwardly;
a plurality of upwardly extending fingers rotatably attached to said collet;
said outer hanger body having at its inner surface latching means for latching said collet at a predetermined location, and a recess for receiving said fingers at a predetermined distance from said latching means, said recess bounded on the bottom by a steeply tapered first load surface;
said inner hanger body having a steeply tapered outwardly extending second load surface substantially parallel to said first load surface; and
said fingers located on said collet a distance from the latching means such that, when said collet is latched said fingers rotate outwardly at a location to move within said recess and rest on said first load surface, said second load surface resting on said fingers after the release of said collet from said inner hanger body.

12. A mudline casing hanger assembly as in claim 11: said upwardly extending fingers being attached to said collet by flexible straps.

13. A mudline casing hanger assembly as in claim 12: said steeply tapered load surfaces having an angle with respect to the vertical between 6° and 20°.

14. A mudline casing hanger assembly as in claim 13: the upper and lower surfaces of said fingers being serrated.

* * * * *